United States Patent [19]

Kunita et al.

[11] 4,411,247

[45] Oct. 25, 1983

[54] DISTRIBUTORLESS IGNITION SYSTEM FOR MULTICYLINDER INTERNAL-COMBUSTION ENGINES

[75] Inventors: Shizuo Kunita, Kawagoe; Osamu Akimoto, Niiza; Osamu Sugie, Handa; Michio Iyoda; Kazuo Suzuki, both of Kariya, all of Japan

[73] Assignees: Sanke Electric Co., Ltd., Saitama; Nippondenso Co., Ltd., Aichi, both of Japan

[21] Appl. No.: 252,251

[22] Filed: Apr. 8, 1981

[30] Foreign Application Priority Data

Apr. 24, 1980 [JP] Japan ..... 55-54692

[51] Int. Cl.[3] ..... F02P 5/00

[52] U.S. Cl. ..... 123/655; 357/13; 357/76

[58] Field of Search ..... 123/655, 656, 643, 633; 357/13, 76

[56] References Cited

U.S. PATENT DOCUMENTS

| | | | |
|---|---|---|---|
| 2,985,797 | 5/1961 | Williams et al. | 123/655 |
| 3,264,531 | 8/1966 | Dickson, Jr. | 357/76 |
| 3,274,454 | 9/1966 | Haberecht | 357/76 |
| 3,319,136 | 5/1967 | Perry et al. | 357/76 |
| 3,662,233 | 5/1972 | Clerc et al. | 357/13 |
| 3,910,247 | 10/1975 | Hartig | 123/655 |
| 4,262,295 | 4/1981 | Okano et al. | 357/13 |

OTHER PUBLICATIONS

"Automotive", *Electronics*, vol. 51, No. 9, pp. 40–41, Apr. 27, 1978.

*Primary Examiner*—Parshotam S. Lall

*Attorney, Agent, or Firm*—Woodcock, Washburn, Kurtz, Mackiewicz & Norris

[57] ABSTRACT

An ignition system of the type incorporating, instead of the usual distributor, high-voltage rectifier diodes connected between the secondary winding of an ignition coil and respective spark plugs. In response to voltages developed in the secondary winding in its opposite directions the diodes function to cause discharges at the spark plugs in the firing order of the engine. Each diode is composed of a multiplicity of laminated silicon rectifier diode chips each having a reverse breakdown voltage in the range of 400–850 volts. The reverse breakdown voltage of each diode is 1.1 to 1.8 times the maximum discharge voltage of the spark plugs. Thus constructed, the diodes can well withstand overvoltages that may develop in the secondary circuit of the ignition system.

5 Claims, 8 Drawing Figures

DISTRIBUTORLESS IGNITION SYSTEM FOR MULTICYLINDER INTERNAL-COMBUSTION ENGINES

BACKGROUND OF THE INVENTION

Our invention pertains to an ignition system for multicylinder, spark-ignition, internal-combustion engines such as those for motor vehicles, and more specifically to improvements in an ignition system of the type having no rotary switch known as the ignition distributor.

An ignition system has been suggested which dispenses with the usual distributor (shown in FIG. 1 of the drawings attached hereto). The known distributorless ignition system incorporates, instead of the distributor, rectifying diodes connected between the secondary winding of an ignition coil or transformer and respective spark plugs. As voltages are induced in the secondary winding in its opposite directions in timed relation with the revolutions of the engine crankshaft, the diodes function to cause the spark plugs to ignite the compressed charges in the cylinder combustion chambers in a prescribed sequence.

The omission of the distributor with its mechanical contacts offers the advantage of no interference noise production. However, abnormally high or abrupt voltages that almost inevitably develop in the system have been easy to degrade or destroy the rectifying diodes. These diodes have had to be of construction well withstanding such overvoltages. If the discharge voltage of the spark plugs ranges between 10 and 25 kilovolts (kV), for example, then the rated maximum (peak) total reverse voltage $V_{RM}$ of the diodes has had to be more than 45 kV. (Actual breakdown voltage is considerably higher than $V_{RM}$.)

Such high voltage diodes normally take the form of laminated diode chips. Usually the breakdown voltage of each diode chip has been set at 1000 V or more in order to reduce the number of laminated chips to a minimum from an economic point of view. Even if the $V_{RM}$ of the diodes is made about 45 kV, their properties have been easy to deteriorate unless sufficient measures are taken against destruction.

Thus the conventional distributorless ignition system could be relied upon for satisfactory performance in actual use only when the rectifying diodes were made capable of withstanding overvoltages far above the normal range in which they were intended to operate. Such diodes are of course very costly. The diodes and other pertinent parts of the ignition system must further be sufficiently insulated against the possible excessive overvoltages. For all these reasons the prior art system has failed to find widespread acceptance.

SUMMARY OF THE INVENTION

In making the present invention, therefore, we have sought to improve the known distributorless ignition system to make it more reliable of operation, inexpensive of manufacture, and thus to enhance its practical utility.

For the attainment of the above and other objects we propose the use of high-voltage rectifier diodes, each composed of a multiplicity of stacked silicon chips, that are capable of functioning even in their reverse breakdown region. Each diode has a reverse breakdown voltage ranging from about 1.1 to 1.8 times the maximum discharge voltage of the spark plugs used in the ignition system. Further each of the stacked chips forming each diode has a reverse breakdown voltage in the range of from about 400 to 850 V.

By the term "maximum discharge voltage", as used herein and in the claims appended hereto, is meant the maximum of voltages at which discharges occur at the spark plugs when the engine is in normal operation and when the plugs have proper interelectrode gaps. In a given engine the discharge voltage of each spark plug is high at low crankshaft speed, becoming lower as the speed increases. The maximum discharge voltage normally appears when the engine picks up speed from its idling state by rapid throttling.

It is now assumed that the spark plugs incorporated in the ignition system of our invention discharge in a voltage range of 10 through 25 kV. Being 1.1 to 1.8 times the maximum discharge voltage, 25 kV, of the spark plugs, the reverse breakdown voltage of each diode is somewhere between 27.5 and 45 kV. With such reverse breakdown voltage setting, the diodes absorb, so to say, overvoltages by their avalanche breakdown, instead of blocking them. This results in the reduction of overvoltages actually developing in the ignition circuits of the system, so that the insulations of the system parts are easier than heretofore, with the consequent elimination of troubles arising from poor insulations.

Each diode having the above specified range of reverse breakdown voltage is formed by the lamination of a required number of silicon chips each having a reverse breakdown voltage ranging from about 400 to 850 V. The diodes of this construction can well withstand extremely steep overvoltages or operation in their reverse breakdown region, suffering no deterioration or rupture under any possible adverse conditions that may take place in the ignition system.

If the reverse breakdown voltage of each diode were made higher than about 1.8 times the maximum discharge voltage of the spark plugs, its ability of restricting overvoltages would lessen. Such a diode would also require an increased number of chips to possess a desired voltage-withstanding capacity, resulting in the higher cost of the diode. On the other hand, if the reverse breakdown voltage of each diode were less than about 1.1 times the maximum discharge voltage, undesired conduction might take place through the ignition circuits of the system. Further the diodes might be unable to absorb overvoltages without destruction. Should the per-chip reverse breakdown voltage of each diode, itself having the above range of reverse breakdown voltage, be more than about 850 V, the diode might again be unable to absorb overvoltages without destruction. If the reverse breakdown voltage of each diode chip were less than about 400 V, on the other hand, then each diode would require too many chips and so become costly.

The improvements according to our invention results in the provision of a highly reliable ignition system which demands a minimum of manufacturing and maintenance costs, thus paving the way for its extensive usage. With the advent of computerized motor vehicles, which must be free of interference, and with the enforcement of more and more stringent legal restrictions on all sources of interference noise, the provision of such a high utility ignition system without the long-familiar distributor will certainly be a boon to automotive and other industries.

The above and other objects, features and advantages of our invention and the manner of attaining them will become more apparent, and the invention itself will best be understood, from a study of the following description and appended claims, with reference had to the attached drawings.

DETAILED DESCRIPTION

Figure 1:
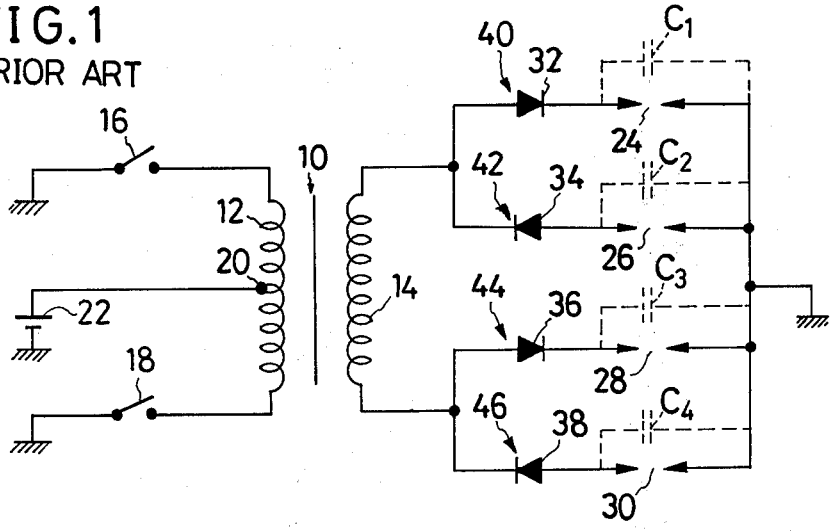
FIG. 1 PRIOR ART
FIG. 1 is a schematic electrical diagram of the known distributorless ignition system which is subject to improvement by our invention.

It will redound to a better understanding of our invention to describe, in some more detail, the known distributorless ignition system bearing particular pertinence to the invention. FIG. 1 shows the prior art system as adapted for use with four-stroke-cycle, four-cylinder engines on motor vehicles. It includes an ignition coil or transformer 10 having a primary winding 12 and a secondary winding 14. The ignition coil primary 12 has one of its extremities grounded via a first breaker switch 16, and the other extremity likewise grounded via a second breaker switch 18, besides being center-tapped at 20 for connection to a power supply 22.

The two breaker switches 16 and 18 can in practice be either mechanical or electronic ones, turned on and off in prescribed relation with the angular position of the engine crankshaft. The closing and opening of the first breaker switch 16 results in the development of a voltage in the ignition coil secondary 14 in a first (upward as viewed in FIG. 1) direction. The closing and opening of the second breaker switch 18 results in the development of a voltage in the ignition coil secondary 14 in a second (downward) direction.

Connected to the ignition coil secondary 14, on the other hand, are four spark plugs 24, 26, 28 and 30 via respective high-voltage rectifier diodes 32, 34, 36 and 38. The series connections of these spark plugs and rectifier diodes provide the four ignition circuits designated 40, 42, 44 and 46 respectively. The first 40 and second 42 ignition circuits are both connected at one end to one of the extremities of the ignition coil secondary 14, and the third 44 and fourth 46 ignition circuits are both connected at one end to the other extremity of the ignition coil secondary. The other ends of all the ignition circuits are interconnected and grounded.

The first 32 and fourth 38 rectifier diodes are both oriented to permit current flow therethrough in response to the voltage developed in the upward direction in the ignition coil secondary 14. The second 34 and third 36 rectifier diodes are both oriented to permit current flow therethrough in response to the voltage developed in the downward direction in the ignition coil secondary 14.

It is thus seen that a voltage is induced in the upward direction in the ignition coil secondary 14 as the first breaker switch 16 closes and then opens at one of the successive firing moments, in step with the revolutions of the engine crankshaft. This secondary voltage is impressed to both first 24 and fourth 30 spark plugs as the surge of current flows through the circuit comprising the ignition coil secondary 14, first diode 32, first spark plug 24, fourth spark plug 30, and fourth diode 38. Thereupon electric discharges take place across the interelectrode gaps of the spark plugs 24 and 30. On the other hand, as the second breaker switch 18 closes and then opens at another firing moment, a voltage is induced in the downward direction in the ignition coil secondary 14. This secondary voltage is impressed to both second 26 and third 28 spark plugs through the circuit of the ignition coil secondary 14, third diode 36, third spark plug 28, second spark plug 26, and second diode 34. Then discharges occur across the gaps of the spark plugs 26 and 28.

As is well known, multicylinder engines are usually made smooth running by causing the several pistons to arrive at their firing top center positions in evenly spaced intervals of time. The ignition system must distribute the ignition impulses to the cylinders in their predetermined firing order. Let it be assumed that, in the four-stroke-cycle, four-cylinder engine now under consideration, the first cylinder is on the intake stroke, the second cylinder on the compression stroke, the third cylinder on the exhaust stroke, and the fourth cylinder on the power stroke, at a first moment of time. At a second moment, when the first cylinder proceeds to the compression stroke, the second cylinder is on the power stroke, the third cylinder on the intake stroke, and the fourth cylinder on the exhaust stroke. At a third moment immediately following the second moment the first cylinder is on the power stroke, the second cylinder on the exhaust stroke, the third cylinder on the compression stroke, and the fourth cylinder on the intake stroke. At a subsequent fourth moment the first cylinder is on the exhaust stroke, the second cylinder on the intake stroke, the third cylinder on the power stroke, and the fourth cylinder on the compression stroke. The four cylinders repeat these four-stroke cycles in timed relation to each other.

It is understood that the noted first, second, third and fourth cylinders are associated with the first, second, third and fourth spark plugs, respectively, of the ignition system of FIG. 1. At the aforesaid first moment, when the piston of the second cylinder approaches top dead center on its compression stroke, the second breaker switch 18 is timed to cause the development of a voltage in the ignition coil secondary 14 in its downward direction. The resulting surge of current is led first to the third spark plug 28 and then to the second spark plug 26. The third cylinder is then near the end of the exhaust stroke. Because of the lower fluid pressure in the third cylinder the third spark plug 28 has a lower discharge voltage than the second 26. Thus discharge occurs not only at the third 28 but also at the second 26 spark plug, and the latter ignites the compressed air-fuel mixture in the combustion chamber of the second cylinder, causing the same to proceed to the power stroke. Of course the third spark plug does not substantially ignite the burnt gases being exhausted.

At the second moment the first breaker switch 16 functions to cause the development of a voltage in the ignition coil secondary 14 in its upward direction, resulting in discharges at the first 24 and fourth 30 spark plugs. Likewise, at the third and fourth moments, discharges take place at the second 26 and third 28 spark plugs and at the first 24 and fourth 30 spark plugs, respectively. Although two spark plugs discharge simultaneously at each moment, only one of them fires the compressed charge in the combustion chamber of the corresponding cylinder, as is apparent from the foregoing description of the first moment.

This prior art ignition system possesses the advantages and disadvantages set forth already. Our invention eliminates the disadvantages caused by the diodes 32, 34, 36 and 38 of conventional design, without impairing the advantages gained by the disuse of the distributor.

Let us now consider overvoltages that may develop in the prior art system of FIG. 1, to the degradation or rupture of the diodes 32, 24, 26 and 38 incorporated therein. The ignition circuits of the system will give rise to no excessive overvoltages during its normal operation. Very substantial overvoltages will do develope, however, if the spark plugs are open; that is, if their electrodes are not spaced for proper sparking. In any ignition system that has been designed and manufactured in consideration of normal operating conditions only, therefore, the rectifier diodes in particular will easily deteriorate or rupture from such overvoltages. Ignition systems for vehicle engines should remain trouble-free even under some abnormal conditions.

From the foregoing considerations we have proceeded to study such abnormal conditions and found out that one condition for the development of the most excessive overvoltages is when the first 24 and second 26 spark plugs, or the third 28 and fourth 30 spark plugs, of the ignition system are both open. Under the normal state of these spark plugs discharge will take place at, say, 20 kV, as indicated at A in the graph of FIG. 2. The voltages of the ignition circuits will not become higher. Overvoltages develop in the above abnormal condition, however, because of the presence of the floating capacitances C1, C2, C3 and C4 in the spark plugs and the neighboring parts of the wiring, as indicated by the broken lines in FIG. 1.

Figure 2:
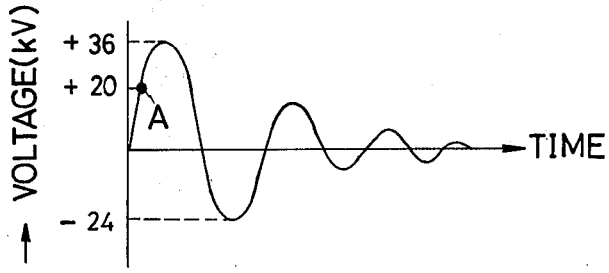
FIG. 2 PRIOR ART
FIG. 2 is a diagram of a waveform appearing in the secondary circuit of the prior art ignition system in the event of a trouble in its spark plugs.

Thus, should the first 24 and second 26 spark plugs be both open, voltage oscillations will occur as in FIG. 2 because of the inductance of the ignition coil secondary 14 and the noted floating capacitances. The result will be the application of an overvoltage to the first rectifier diode 32, through the following procedure.

Let it be supposed that a voltage has just been induced in the ignition coil secondary 14 in its upward direction for firing the charge in the first engine cylinder. This upward voltage is impressed as aforesaid to both first 24 and fourth 30 spark plugs. Since the first spark plug is now assumed to be open, discharge takes place only at the fourth spark plug. Then the floating capacitance C1 associated with the first spark plug will be charged to, say, +36 kV. As a voltage of, say, 24 kV (or −24 kV) subsequently develops in the secondary 14 in its downward direction, the first diode 32 will receive the difference, 60 kV, between this −24 kV and the +36 kV charged to the floating capacitance C1.

We have discovered another set of conditions for the development of the most excessive overvoltages. These are: (1) one of the spark plugs (e.g., 24) has an inordinately high discharge voltage; (2) the spark plug connected inversely in parallel with said one plug (e.g., 26) has a very low discharge voltage; and (3) the floating capacitance (e.g., C1) associated with said one plug is extremely small. Under these conditions, at the instant the first spark plug discharges at the inordinately high voltage, a steep inverse voltage will be applied to the second diode 34 causing a reverse surge of current to flow therethrough. Even if less than the breakdown voltage of the second diode, such a steep inverse voltage could degrade or destroy the diode.

Figure 3:
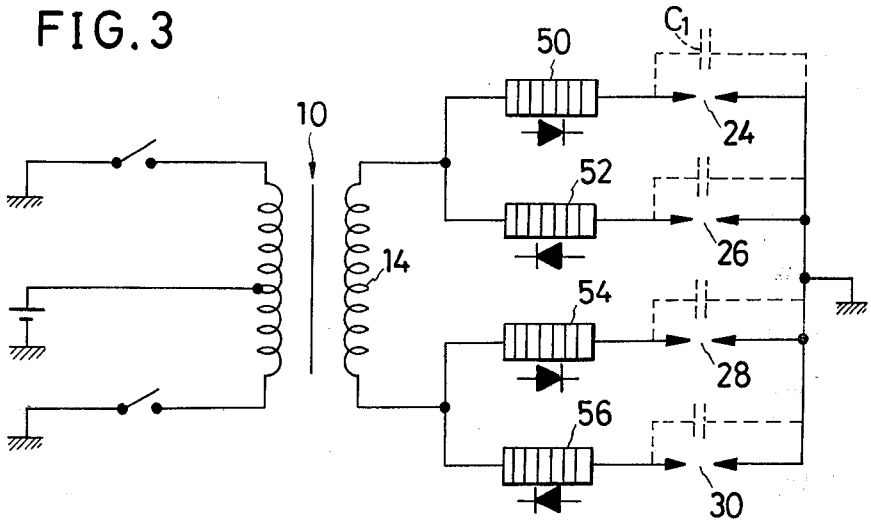
FIG. 3 is a schematic electrical diagram of a preferred form of the improved distributorless ignition system according to our invention, the ignition system being shown adapted for a four-cylinder engine by way of example only.

The improved ignition system according to our invention can withstand the excessive overvoltages even under the foregoing two sets of abnormal conditions. The following is the description of a preferred form of the inventive ignition system, which is shown in FIG. 3 as adapted for four-cylinder engines. An inspection of this figure will reveal that, except for the details of the four rectifying diodes herein designated 50, 52, 54 and 56, the configuration of the improved ignition system is analogous with that of the prior art system of FIG. 1. We will therefore discuss only these diodes in detail, it being understood that the foregoing description of the prior art system largely applies to the inventive system in other respects.

Each rectifying diode 50, 52, 54 and 56 according to our invention is a high-voltage avalanche diode which is formed by the lamination of a multiplicity of diode chips and which is operable in its reverse breakdown region without degradation or destruction. All these diodes 50, 52, 54 and 56 are used in place of the diodes 32, 34, 36 and 38 of the prior art system, forming the series circuits with the spark plugs 24, 26, 28 and 30, respectively. As indicated by the diode symbols in FIG. 3, the first 50 and fourth 56 diodes are oriented to permit current flow therethrough in response to the voltage developed in the first or upward direction in the secondary 14 of the ignition coil or transformer 10. The second 52 and third 54 diodes are oriented to allow current flow therethrough in response to the voltage developed in the second or downward direction in the ignition coil secondary 14.

Figure 4:
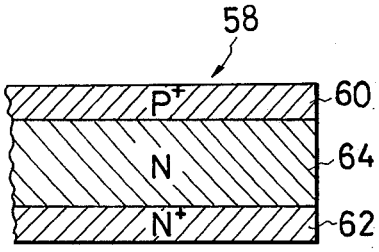
FIG. 4 is a fragmentary elevational view of one of the laminated chips forming each high-voltage rectifier diode in the improved system of FIG. 3.

FIG. 4 is a schematic representation of each of the chips to be laminated to form each diode 50, 52, 54 or 56. Generally designated 58, each diode chip is fabricated from an n-type silicon substrate with a size of 240 microns by 0.6 millimeters (mm) by 0.6 mm and a resistivity of about 12 ohm-centimeters (ohm-cm). It has a $p^+$-type region 60 formed by diffusion through one of its opposite surfaces, with a surface impurity concentration of $10^{19}$ to $10^{20}$ atoms per $cm^3$, and an $n^+$-type region 62 formed by diffusion through the other surface, with a surface impurity concentration of $10^{20}$ to $10^{21}$ atoms/$cm^3$. The $p^+$-type region 60 has a thickness of about 40 microns, and the $n^+$-type region has a thickness of about 60 microns, thus leaving therebetween an n-type substrate region 64 with a thickness of about 140 microns. No lifetime killer such as gold is diffused.

Figure 5:
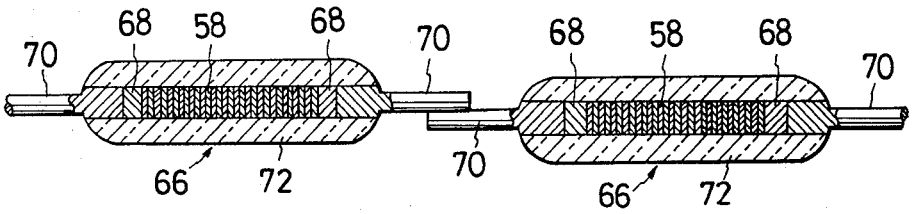
FIG. 5 is a cross-sectional view of two diode chip subassemblies, each subassembly comprising a plurality of diode chips of the type shown in FIG. 4, the subassemblies being connected in series.

As illustrated in FIG. 5, each of the improved rectifying diodes 50, 52, 54 and 56 takes the form of the series connections of two diode-chip subassemblies 66. Each subassembly comprises 30 diode chips 58 stacked together, with a pair of p+-type silicon chips 68 brazed onto the opposite ends of the stack by way of protection. A pair of electrode leads 70 are also brazed onto the silicon chips 68 and extend away therefrom. A glass molding 72 encloses all but the leads of the noted subassembly components. The two opposed leads 70 of the two subassemblies are connected together, also by brazing, to provide one of the four improved rectifying diodes for use in the ignition system of our invention. Preferably, for actual installation in place, the assembly of FIG. 5 is further encased in a housing, not shown, of molded plastics or like material.

It is thus seen that each rectifying diode 50, 52, 54 or 56 comprises 60 silicon diode chips 58, all oriented in the same direction. Each diode has a reverse breakdown voltage from about 1.1 to 1.8 times as much as the maximum discharge voltage of the spark plugs intended for use therewith. Each diode chip has a reverse breakdown voltage ranging from about 400 to 850 V. Although the actual values of the reverse breakdown voltage may differ from chip to chip because of unavoidable manufacturing errors, they average about 660 V. The reverse breakdown voltage of each 60-chip diode is therefore about 40 kV.

If each diode chip is of the p+nn+ silicon type, as shown in FIG. 4, then its reverse breakdown voltage can be set in the desired range of 400–850 V by making the average resistivity of the p+-type region from about 0.0001 to 1 ohm-cm, the resistivity of the n-type region from about 6.5 to 22.5 ohm-cm, and the average resistivity of the n+-type region from about 0.0001 to 1 ohm-cm. The invention also permits the use of chips of the p+pn+ silicon type. The reverse breakdown voltage of each such chip can be set in the above range by making the average resistivity of the p+-type region from about 0.0001 to 3 ohm-cm, the resistivity of the p-type region from about 18 to 60 ohm-cm, and the average resistivity of the n+-type region from about 0.0001 to 3 ohm-cm.

Figure 6:
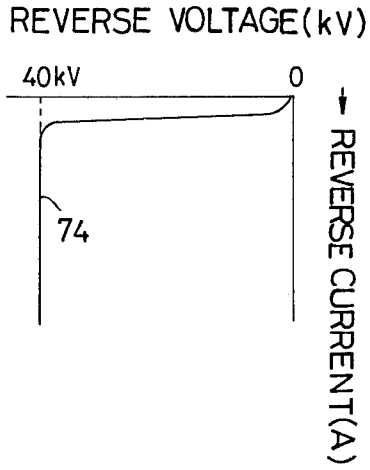
FIG. 6 is a graphic representation of the reverse performance characteristic of the high-voltage rectifier diode of FIG. 5.

Each rectifying diode of the foregoing configuration according to our invention has a permissible reverse loss of well over two watts (W) with respect to the sustained application of a train of pulses, each with a duration of 300 microseconds, at a rate of 50 per second. This means that the diodes can operate even in their breakdown region in the reverse direction. The reverse breakdown region is indicated at 74 in the graph of FIG. 6, which plots the characteristic curve of the diodes in the reverse direction. We have ascertained that a certain degree of avalanche breakdown of the diodes in this reverse breakdown region 74 does not result in their deterioration or destruction.

The operation of the improved ignition system of FIG. 3 is identical with that of the prior system of FIG. 1 as long as the spark plugs 24, 26, 28 and 30 are all functioning normally, so that no repeated description of such normal operation will be necessary. One of the operational features of the improved system is that no such excessive overvoltage as that explained in relationship with FIG. 2 develops even when, for instance, the first 24 and second 26 spark plugs both become open and so unable to ignite the compressed cylinder charges. A much lower voltage will then appear, depending upon the particular breakdown characteristic of the rectifying diodes in use, for the following reason.

Figure 7:
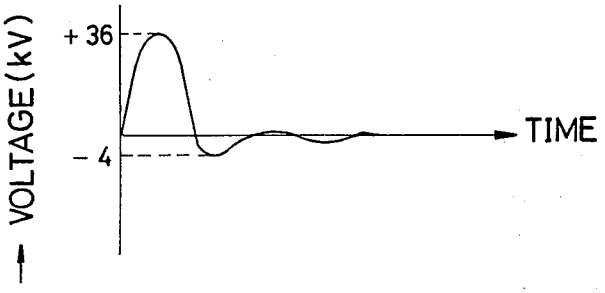
FIG. 7 is a waveform diagram explanatory of the way in which the high-voltage rectifier diodes restrict the development of overvoltages in the improved system of FIG. 3.

We will first assume that the spark plugs 24 and 26 are both open. If then a voltage is induced in the ignition coil secondary 14 in its upward direction for causing discharge at the first spark plug 24, the secondary circuit will tend to apply an overvoltage of, say, 60 kV to the first rectifying diode 50, as has been explained in connection with FIG. 6. However, by virtue of the breakdown characteristic of the diode graphically represented in FIG. 6, the voltage in the secondary circuit becomes no greater than the 40 kV breakdown voltage of the diode, as will be understood from the graph of FIG. 7. The diode 50 will then operate in the reverse breakdown region 74 in FIG. 6 as it receives a succession of pulses with a duration of 300 microseconds or so. The loss of the diode in the reverse direction maximizes, at about 2 W, when the engine speed is at about 3000 revolutions per minute, with the consequent pulse application to the diode at a rate of 50 per second. Accordingly the diode can operate within its permissible reverse loss, suffering neither degradation nor destruction.

The foregoing overvoltage operation of the first diode 50 is typical of the four diodes used in the ignition system. The other diodes operate similarly under like abnormal conditions.

Let us then consider the behavior of the improved diodes under the second recited set of conditions for the development of the most excessive overvoltages. To better illustrate the problem we will assume that the discharge voltage of the first spark plug 24 is as high as 30 kV, that the discharge voltage of the second spark plug 26 is as low as 3 kV, and that the floating capacitance C1 is negligibly small. Under these abnormal conditions a steep inverse voltage will be impressed to the second diode 52, causing the corresponding surge of current to flow reversely therethrough.

Such steep overvoltages would not be tolerated by the conventional high-voltage diodes formed by the lamination of diode chips each having a breakdown voltage of 1000 V or more. The improved diodes according to our invention have the mentioned range of breakdown voltage. Moreover the average breakdown voltage of each p+nn+-type diode chip 58, FIG. 4, is made as low as 660 V by making the resistivity of its n-type substrate region 64 lower than heretofore. With its reverse-voltage-withstanding capacity thus improved, the second diode 52 can well tolerate the steep inverse voltage without any substantial degradation or rupture. The same holds true with the other diodes 50, 54 and 56 of the ignition system.

Preferably, for the fabrication of each improved diode according to our invention, a prescribed number of, for example, p+nn+-type silicon wafers and a pair of p+-type silicon wafers are stacked up and brazed together. The lamination of silicon wafers is then cut into small squares, or dice, by so-called "dicing" or sawing or machining with steel wire or circular blades. This fabrication method is preferred as it permits mass production. However, the diode chips thus produced are limited to the square shape, although the corners of the squares are ultimately rounded by chemical etching. Such square diode chips, as heretofore constructed, have been susceptible to degradation or rupture due to steep inverse overvoltages in particular as their corners provide points of weakness. The improved diodes of our invention suffer no such failures because the reverse breakdown voltages of each diode and each diode chip are set in the above specified ranges.

The foregoing will have made clear that out invention succeeds in the reduction of overvoltages that may develop in the secondary circuit of the ignition system, by causing such over-voltages to be taken up in the reverse breakdown region of the rectifying diodes. The insulation of the secondary circuit is easier than in the prior art. Further the use of the high-voltage rectifier diodes, free from failures under the most severe conditions of abnormality, materially contributes to the reliable operation of the ignition system. All these advantages combine, moreover, to lessen the manufacturing and maintenance costs of the ignition system.

Figure 8:
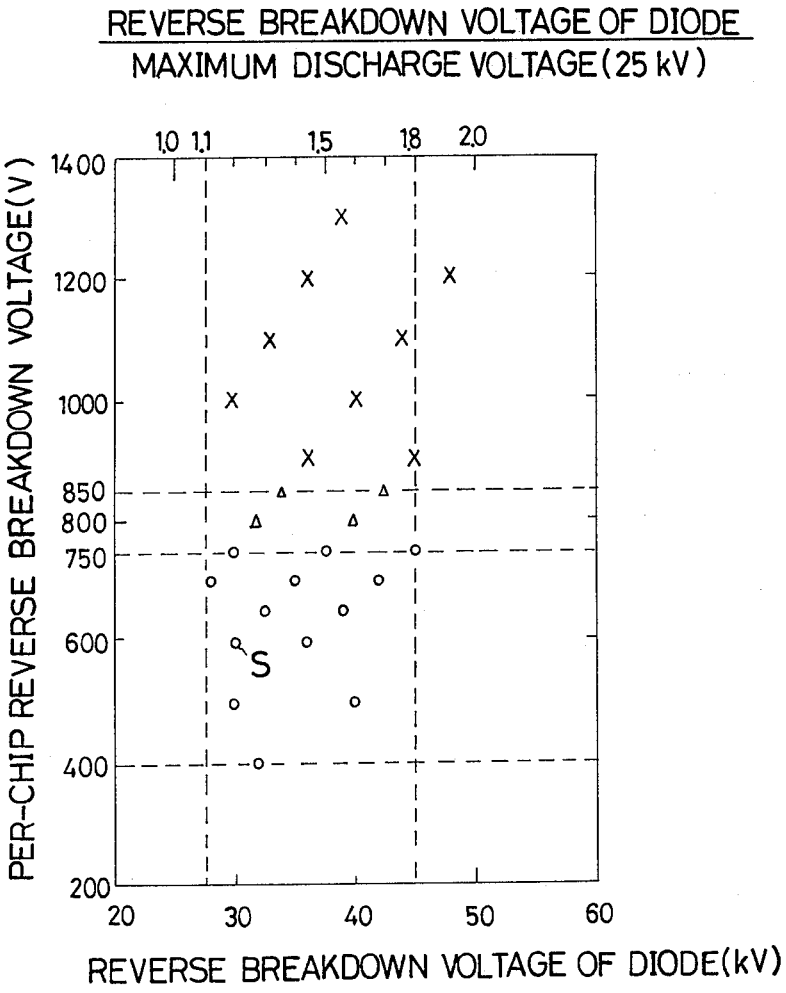
FIG. 8 is a graph plotting the relationship between per-chip and per-diode breakdown voltages and the performances of the diodes in response to steep inverse voltages that may appear in the ignition system.

FIG. 8 is a graphic summary of testing the voltage-withstanding abilities of some high-voltage diode samples having various per-diode and per-chip reverse breakdown voltages. We made the tests in the ignition system of FIG. 3 under the above described hardest conditions of abnormality, such that very steep inverse overvoltages were applied to the diodes at the instant discharge took place at the spark plugs. The tested samples were all of the basic configuration illustrated in FIGS. 3, 4 and 5, but with different resistivities of the n-type substrate regions 64 of the diode chips 58 and with different numbers of such chips stacked together. The vertical axis of the graph represents the mean per-chip reverse breakdown voltage of each diode, with fluctuations of plus or minus 10% from chip to chip. The bottom horizontal axis represents the reverse breakdown voltage of each diode fabricated from the chips having the reverse breakdown voltage given on the vertical axis. The top horizontal axis represents the ratio of the reverse breakdown voltage of each diode to the maximum discharge voltage to the spark plugs having the normal interelectrode gaps. The maximum discharge voltage in this instance was 25 kV.

Thus, for example, the tested diode sample designated S in FIG. 8 has a reverse breakdown voltage of 30 kV and comprises 50 chips each having a reverse breakdown voltage of 600 V. The circles and triangles indicate those diode samples which exhibited no and hardly any failures, respectively, such as a decrease in breakdown voltage and short-circuiting under the test conditions. The crosses represent those samples which did suffer such failures or which were totally destroyed. It will therefore be seen that the lamination of 50 diode chips each with a reverse breakdown voltage of 600 V provides a very favorable diode, as indicated by the sample S marked by the circle.

The graph proves that the per-chip reverse breakdown voltage of the diodes for use in the ignition system of our invention should be in the range of from about 400 to 850 V. We have confirmed by experiment, however, that the samples marked by the triangles are more susceptible to failures when subjected to greater overvoltages than are those marked by the cicles. Further, if per-chip breakdown voltages fluctuate considerably in any single diode, degradation may occur at the chips having the higher reverse breakdown voltages. Such localized degradation can be avoided by making the average per-chip reverse breakdown voltage less than about 750 V and, preferably, by making the maximum per-chip reverse breakdown voltage less than about 850 V. For limiting the per-chip reverse breakdown voltage to the range of 400 to 750 V, the resistivity of the n-type region may be set in the range of 6.5 to 17.5 ohm-cm if the chips are of the $p^+nn^+$ silicon type, and the resistivity of the p-type region may be set in the range of 18 to 50 ohm-cm if the chips are of the $p^+pn^+$ silicon type.

Although we have shown and described our invention in terms of a preferred embodiment thereof, we recognize, of course, that the invention is susceptible to a variety of modifications or alterations within the usual knowledge of one skilled in the art. For example, each rectifying diode need not necessarily be composed of two subassemblies of laminated chips as shown in FIG. 5. Although the division of the diode chips into two or more subassemblies is preferred in view of the ease of manufacture if their total number exceeds 50 or so, all the chips could of course be integrated into a single assembly. Further the diode chips might be of round, hexagonal or other shape, even though the advantages offered by our invention will be most pronounced if they are in the form of squares as in the illustrated embodiment. Other possible modifications include the use of an autotransformer as the ignition coil, and of breaker switches of various circuit configurations in the primary circuit of the system. It will be needless to say that our invention lends itself to adaptation for multicylinder engines other than those of the four-cylinder design.

All these and other changes, modifications and adaptations of our invention are intended in the foregoing disclosure. It is therefore appropriate that the invention be construed broadly and in a manner consistent with the fair meaning or proper scope of the following claims.

We claim:

1. In an ignition system for a multicylinder, spark-ignition, internal-combustion engine, wherein an ignition coil develops voltages in its two opposite directions for causing discharges at first, second, third and fourth spark plugs in timed relation to the revolutions of the engine, the improvement which comprises:

(a) a first high-voltage rectifier diode connected in series with the first spark plug to form a first ignition circuit which is connected at one end to one extremity of the ignition coil, the first diode being oriented to permit current flow to the first spark plug in response to the voltage developed in a first direction in the ignition coil;

(b) a second high-voltage rectifier diode connected in series with the second spark plug to form a second ignition circuit which is connected at one end to said one extremity of the ignition coil and at the other end to the other end of the first ignition circuit, the second diode being oriented to permit current flow to the second spark plug in response to the voltage developed in a second direction in the ignition coil;

(c) a third high-voltage rectifier diode connected in series with the third spark plug to form a third ignition circuit which is connected at one end to the other extremity of the ignition coil and at the other end to said other ends of the first and second ignition circuits, the third diode being oriented to permit current flow to the third spark plug in response to the voltage developed in the second direction in the ignition coil; and (d) a fourth high-voltage rectifier diode connected in series with the fourth spark plug to form a fourth ignition circuit which is connected at one end to said other extremity of the ignition coil and at the other end to said other ends of the first, second and third ignition circuits, the fourth diode being oriented to permit current flow to the fourth spark plug in response to the voltage developed in the first direction in the ignition coil;

(e) each diode comprising a stack of square-shaped silicon rectifier diode chips, each having a reverse breakdown voltage in the range of from about 400 to about 850 volts in order to enable the diode to withstand steep overvoltages, the reverse breakdown voltage of each diode ranging from about 27.5 to about 45.0 kilovolts, whereby each diode can function without degradation or rupture even when current flows therethrough in its reverse breakdown region, and can dampen voltages greater than the reverse breakdown voltage thereof.

2. The improved ignition system as recited in claim 1, wherein each silicon rectifier diode chip is of the $p^+pn^+$ type, comprising a $p^+$-type silicon region having an average resistivity ranging from about 0.0001 to 3 ohm-centimeters, a p-type silicon region having a resistivity ranging from 18 to 60 ohm-centimeters, and an $n^+$-type silicon region having an average resistivity ranging from about 0.0001 to 3 ohm-centimeters.

3. The improved ignition system as recited in claims 1 or 2, wherein each high-voltage rectifier diode is an avalanche diode.

4. The improved ignition system as recited in claim 1, wherein each high-voltage rectifier diode further comprises a pair of $p^+$-type silicon chips secured to the opposite ends of the laminated silicon rectifier diode chips, a pair of electrode leads secured to the respective $p^+$-type silicon chips, and means enclosing all but the leads of the diode.

5. The improved ignition system as recited in claim 1, wherein each silicon rectifier diode chip is of the $P^+nn^+$ type, comprising a $p^+$-type silicon region having an average resistivity ranging from about 0.0001 to 1 ohm-centimeter, an n-type silicon region having a resistivity ranging from about 6.5 to 22.5 ohm-centimeters, and an $N^+$-type silicon region having an average resistivity ranging from about 0.0001 to 1 ohm-centimeter, and wherein the silicon rectifier diode chips of each high-voltage rectifier diode are stacked in at least two separate groups to form diode-chip subassemblies, each subassembly further comprising a pair of $p^+$-type silicon chips secured to the opposite ends of the stack of diode chips, and a pair of electrode leads connected to the respective $p^+$-type silicon chips, one of the electrode leads of each diode-chip subassembly being connected to one of the electrode leads of the other diode-chip subassembly to form one high-voltage rectifier diode.

* * * * *